US010906718B2

(12) United States Patent
Sim et al.

(10) Patent No.: US 10,906,718 B2
(45) Date of Patent: Feb. 2, 2021

(54) TRAY WITH BUFFERING MEMBERS FOR CARRYING DISPLAY PANEL

(71) Applicant: Samsung Display Co., Ltd., Yongin-si (KR)

(72) Inventors: Bo Bae Sim, Yongin-si (KR); Min Yeob Kang, Yongin-si (KR); Ja Huem Koo, Yongin-si (KR); Nam Pyo Hong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/410,892

(22) Filed: May 13, 2019

(65) Prior Publication Data

US 2020/0122913 A1 Apr. 23, 2020

(30) Foreign Application Priority Data

Oct. 18, 2018 (KR) ..... 10-2018-0124596

(51) Int. Cl.
*B65D 81/05* (2006.01)
*B65D 85/30* (2006.01)
*B65D 81/02* (2006.01)

(52) U.S. Cl.
CPC ..... *B65D 81/053* (2013.01); *B65D 81/022* (2013.01); *B65D 85/30* (2013.01)

(58) Field of Classification Search
CPC ..... B65D 81/02; B65D 81/022; B65D 81/05; B65D 81/053; B65D 85/30; B65D 85/38; B65D 85/48; B65D 81/056; G02F 1/13; G02F 1/1333
USPC ..... 206/449, 453, 454, 455, 586
See application file for complete search history.

(56) References Cited

U.S. PATENT DOCUMENTS

| | | | | |
|---|---|---|---|---|
| 2,861,681 | A * | 11/1958 | Lane | B65D 5/5028 206/453 |
| 8,777,007 | B2 * | 7/2014 | Chen | B65D 81/05 206/454 |
| 9,676,509 | B2 * | 6/2017 | Shin | B65D 85/48 |
| 2006/0213797 | A1 * | 9/2006 | Nozaki | G03F 1/64 206/455 |
| 2016/0083173 | A1 * | 3/2016 | Chen | B65D 81/025 206/454 |
| 2019/0204659 | A1 * | 7/2019 | Wang | G02F 1/133308 |

FOREIGN PATENT DOCUMENTS

| | | | | |
|---|---|---|---|---|
| CN | 202704247 | U * | 1/2013 | |
| CN | 205738782 | U * | 11/2016 | |
| KR | 100948194 | B1 * | 3/2010 | G02F 1/13 |
| KR | 101062993 | B1 * | 9/2011 | G02F 1/13 |

(Continued)

*Primary Examiner* — Bryon P Gehman
(74) *Attorney, Agent, or Firm* — Lewis Roca Rothgerber Christie LLP

(57) ABSTRACT

A tray for carrying a display panel is disclosed, and the tray includes a base configured to support the display panel, supporting members on the base and each having an inner surface corresponding to two adjacent sides of each of corner portions of the display panel, and buffering members coupled to the inner surface of each of the supporting members and configured to contact the two adjacent sides of the display panel, wherein the buffering members are spaced apart from the inner surface of each of the supporting members by a set distance.

18 Claims, 5 Drawing Sheets

(56) References Cited

FOREIGN PATENT DOCUMENTS

| | | | |
|---|---|---|---|
| KR | 10-2015-0062605 | A | 6/2015 |
| KR | 10-1551935 | B1 | 9/2015 |
| KR | 10-1633117 | B1 | 6/2016 |

* cited by examiner

TRAY WITH BUFFERING MEMBERS FOR CARRYING DISPLAY PANEL

CROSS-REFERENCE TO RELATED APPLICATION

The application claims priority to and the benefit of Korean Patent Application No. 10-2018-0124596 filed Oct. 18, 2018 in the Korean Intellectual Property Office (KIPO), the entire content of which is incorporated herein in its entirety by reference.

BACKGROUND

1. Field

Embodiments of the present invention relate to a tray for carrying a display panel assembly, and more particularly, to a tray for carrying a display panel.

2. Description of the Related Art

In general, a display panel of a flat panel display, such as a liquid crystal display or an organic light emitting display, includes glass substrates. A display unit is between a lower glass substrate and an upper glass substrate, and a sealing member is formed between the lower glass substrate and the upper glass substrate to surround the display unit, whereby the display unit can be sealed.

The glass substrate has high light transmittance and excellent sealing properties, but can be easily broken by twisting or impact. Therefore, the display panel including the glass substrates is difficult to handle and carry in a manufacturing process. In particular, a display panel assembly can be carried over a long distance for assembly with an external case or the like, and when carried by a vehicle or the like, the display panel assembly may be damaged or broken by movement or impact.

The above information disclosed in this section is only for understanding the background of the inventive concepts, and, therefore, may contain information that does not form prior art.

SUMMARY

Aspects of one or more exemplary embodiments are directed toward a tray for carrying a display panel which can safely protect a display panel from movement or impact.

Aspects of one or more exemplary embodiments also are directed toward a tray for carrying a display panel which can be used corresponding to display panels of various sizes.

According to some exemplary embodiments, a tray for carrying a display panel may include a base configured to support the display panel; supporting members on the base, each having an inner surface corresponding to two adjacent sides of each of corner portions of the display panel; and buffering members coupled to the inner surface of each of the supporting members and configured to contact the two adjacent sides of the display panel, wherein the buffering members may be spaced apart from the inner surface of each of the supporting members by a set distance.

Each of the buffering members may be spaced apart from the inner surface of each of the supporting members by a distance of about 0.5 mm to about 1.5 mm.

The supporting members may be spaced apart from each other at the corner portions.

Each of the supporting members may include grooves formed on the inner surface, and each of the buffering members may be formed in a U shape and two legs of the U shape are configured to be inserted into the grooves.

Each of the supporting members may include grooves formed on the inner surface and a through hole formed in a longitudinal direction, and each of the buffering members may be formed in a trident shape, two legs of the trident shape may be inserted into the grooves, and a middle leg of the trident shape may be bent and inserted into the through hole.

The two legs of the trident shape may be spaced apart from a bottom surface of the grooves by a set distance when inserted into the grooves.

The buffering members may include a material having hardness lower than that of the supporting members.

The supporting members may include at least one selected from plastic and synthetic resin, and the buffering members may include at least one selected from urethane, resin and rubber.

The tray may further comprise an outer wall on the base to surround the supporting members. The outer wall may be made of a foam material.

According to some exemplary embodiments, a tray for carrying a display panel may include a base configured to support the display panel; a supporting member on the base having an inner surface corresponding to two adjacent sides of each of corner portions of the display panel; and buffering members coupled to the inner surface of the supporting member and configured to contact the two adjacent sides of the display panel, wherein the buffering members may be spaced apart from the inner surface of the supporting member by a set distance.

The buffering members may be spaced apart from the inner surface of the supporting member by a distance of about 0.5 mm to about 1.5 mm.

The supporting member may include a recess portion corresponding to each of the corner portions of the display panel.

The supporting member may include grooves formed on the inner surface, and each of the buffering members may be formed in a U shape and two legs of the U shape may be inserted into the grooves.

The supporting member may include grooves formed on the inner surface and a through hole form in a longitudinal direction, and each of the buffering members may be formed in a trident shape, two legs of the trident shape may be inserted into the grooves, and a middle leg of the trident shape may be bent and inserted into the through hole.

The two legs of the trident shape may be spaced apart from a bottom surface of the grooves by a set distance when inserted into the grooves.

The buffering members may include a material having hardness lower than that of the supporting member.

The supporting member may include at least one selected from, plastic and synthetic resin, and the buffering members may include at least one selected from urethane, resin and rubber.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
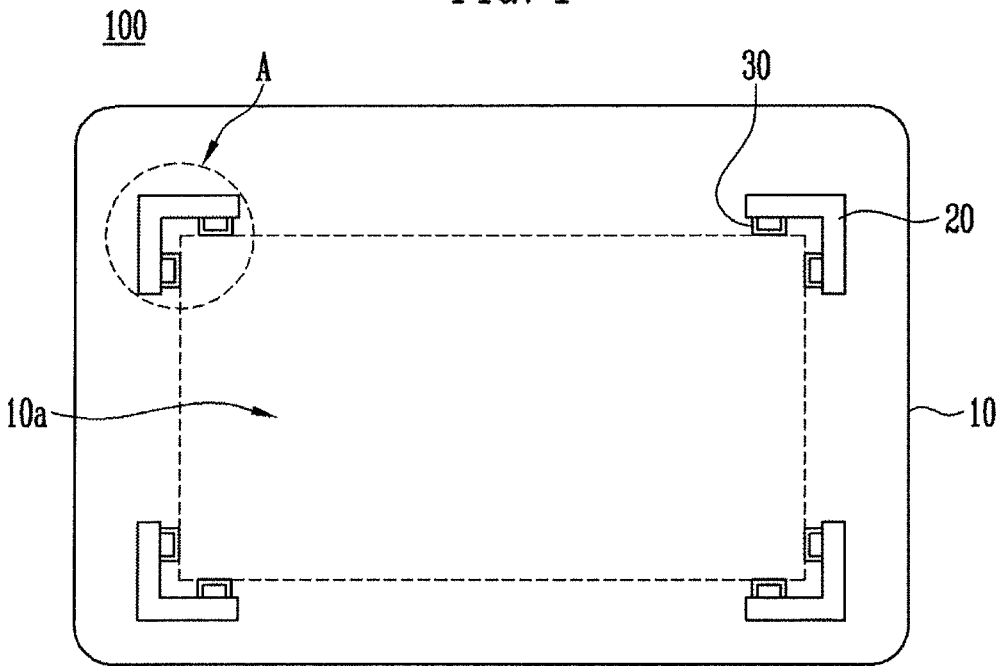
FIG. 1 is a plan view of a tray for carrying a display panel according to an embodiment of the present invention.

Hereinafter, preferred embodiments of the invention will be described in detail with reference to the accompanying drawings. The following embodiments are provided so that those skilled in the art will be able to fully understand the invention. The embodiments can be modified in various ways. The scope of the invention is not limited to the embodiments described below.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

Spatially relative terms, such as "beneath", "below", "lower", "downward", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. In contrast, when an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

The sizes of the elements shown in the drawings may be exaggerated or reduced for convenience of explanation. For example, the size and thickness of each element are arbitrarily shown for convenience of explanation, and thus the invention is not necessarily limited to those shown in the drawings.

FIG. 1 is a plan view of a tray for carrying a display panel according to an embodiment of the invention.

Referring to FIG. 1, a tray 100 for carrying a display panel may include a base 10 in which a seating area 10*a* is defined, one or more supporting members 20 at set or predetermined intervals on the base 10 around the seating area 10*a*, and a plurality of buffering members 30 coupled to an inner surface of each of the one or more supporting members 20 adjacent to the seating area 10*a*.

The base 10 may be in the form of a plate so as to provide the seating area 10*a* having a flat surface. The seating area 10*a* is an area where an object is placed on the tray 100, and may be defined with a set or predetermined shape and size, for example, at a central portion of a surface of the base 10. Although the seating area 10*a* is shown as a rectangular shape in FIG. 1, the shape and size of the seating area 10*a* may be variously changed according to the object to be provided. For example, when corners of the object are rounded, the shape of the seating area 10*a* may correspond to the shape of the object.

The base 10 may be a foam material having a low thermal conductivity, maintaining flatness, and capable of absorbing external impacts well. The base 10 may be made of closed-cell extruded polystyrene foam, for example, Styrofoam (trademark of Dow Chemical Company, USA) closed-cell extruded polystyrene foam, and/or a corrugated cardboard having a multilayered structure.

The one or more supporting members 20 may be at corner portions of the seating area 10*a*, respectively. Each of the one or more supporting members 20 may correspond, for example, to two sides (e.g., two adjacent sides) of each of the corner portions of the seating area 10*a*. Each of the one or more supporting members 20 may be formed in a "L" shape corresponding to the respective corner portions of the seating area 10*a*, and the inner surface of each of the one or more supporting members 20 may be adjacent to the seating area 10*a*.

The one or more supporting members 20 may be made of a plastic material having a relatively high hardness to support the object, such as acrylic resin, for example, polymethyl methacrylate (PMMA), polyacrylonitrile (PAN), polyacrylic acid (PAA), or the like, or a synthetic resin such as acrylonitrile-butadiene-styrene (ABS) resin, or the like.

The buffering members 30 may be between the inner surface of each of the one or more supporting members 20 and the object. A portion of the buffering members 30 that may be in contact with the object may be spaced apart from the inner surface of each of the one or more supporting members 20 by a set or predetermined distance.

Figure 2:
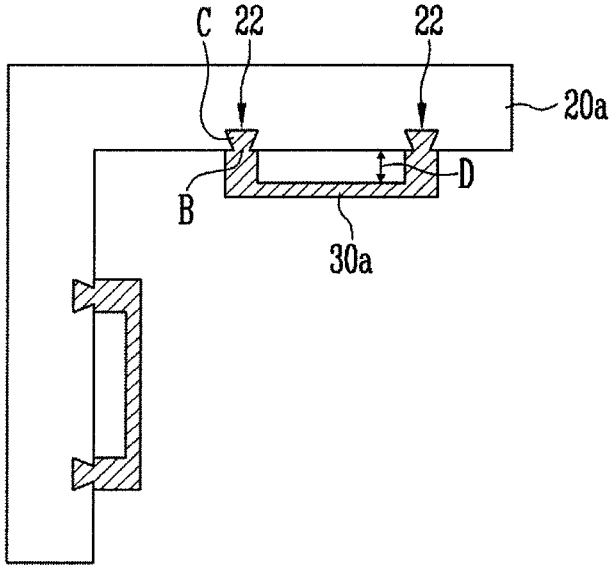
FIGS. 2-3 are enlarged plan views of a portion A of FIG. 1 according to different embodiments of the present invention.

FIG. 2 is an enlarged plan view of a portion A of FIG. 1. FIG. 2 shows an embodiment in which a buffering member 30*a* is coupled to one or more supporting members 20*a*.

Referring to FIG. 2, for example, the buffering member 30*a* may have a "U" shaped plane and two legs of the "U" shape may be coupled to the one or more supporting members 20*a*.

Two grooves 22 may be formed on an inner surface of the one or more supporting members 20*a* and end portions of the two legs of the "U" shape may be inserted into the two grooves 22, respectively. The end portions of the two legs may have a neck portion B having a width shorter than that of another portion and/or a head portion C having a gradually increasing width from the neck portion B to the end portion of the two legs. The two grooves 22 may have a shape in which the neck portion B and the head portion C can be fitted from an upper part of the buffering member 30*a* to the inner surface of the one or more supporting members 20*a*.

By the above described structure, a portion of the buffering member 30*a* that is in contact with the object may be spaced apart from the inner surface of the one or more supporting members 20 by an opening, space, or gap having a distance D. In addition, the buffering member 30*a* is not easily separated from the one or more supporting members 20*a* because the buffering member 30*a* is engaged so as to be fitted downward from the inner surface of the one or more supporting members 20*a*.

Figure 3:
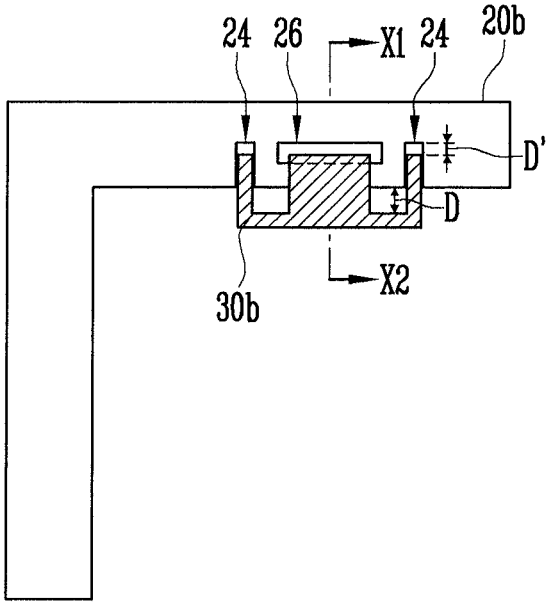
Figure 4:
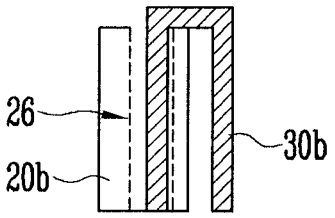
FIG. 4 is a cross-sectional view taken along line X1-X2 of FIG. 3.

FIG. 3 is an enlarged plan view of the portion A of FIG. 1. FIG. 3 shows another embodiment in which a buffering member 30*b* is coupled to one or more supporting members 20*b*. FIG. 4 is a cross-sectional view taken along line X1-X2 of FIG. 3.

Referring to FIGS. 3-4, for example, the buffering member 30*b* may have a "trident" shaped plane and two legs on both sides of the "trident" shape may be inserted into two grooves 24 formed on an inner surface of the one or more supporting members 20*b*, and a middle leg of the "trident" shape may be bent in a longitudinal direction and inserted into a through hole 26 formed in the one or more supporting members 20*b* in the longitudinal direction.

By the above-described structure, a portion of the buffering member 30*b* that is in contact with the object may be spaced apart from the inner surface of the one or more supporting members 20*b* by an opening, space, or gap having a distance D. In addition, end portions of the two legs may be spaced apart from bottom surfaces of the grooves 24 by a distance D' when the two legs are inserted into the grooves 24, respectively. That is, an entire portion of the buffering member 30*b* may be spaced apart from the inner surface of the one or more supporting members 20*b* by a set or predetermined distance.

Figure 5:
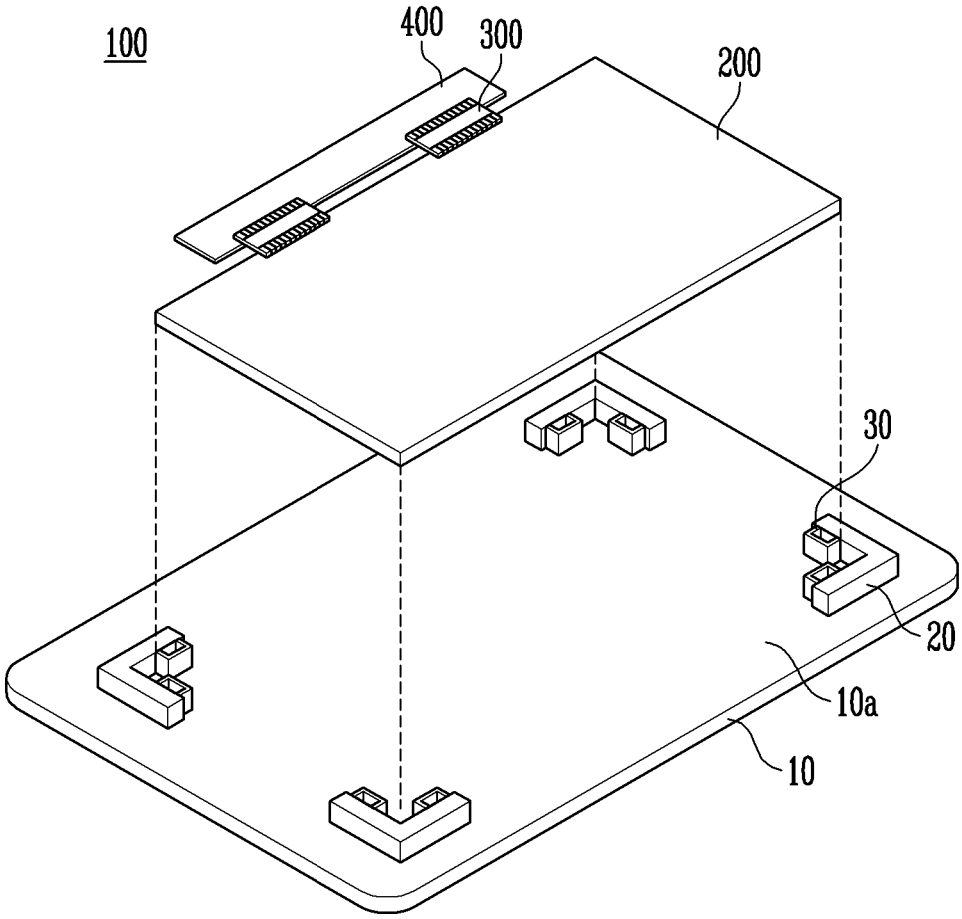
FIG. 5 is a perspective view showing a state in which a display panel assembly is mounted on the tray for carrying a display panel according to an embodiment of the present invention.
Figure 6:
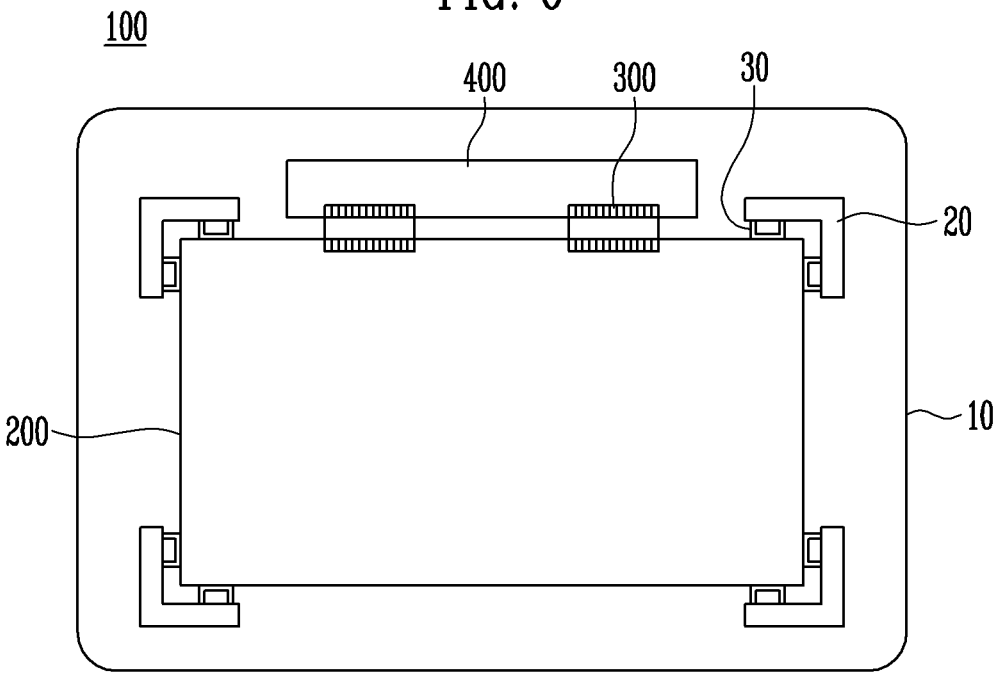
FIG. 6 is a plan view of FIG. 5.

FIG. 5 is a perspective view showing a state in which a display panel assembly is seated on the tray 100 according to the embodiment illustrated in FIG. 1. FIG. 6 is a plan view of FIG. 5.

Referring to FIGS. 5-6, a display panel assembly may be seated on the seating area 10*a* of the base 10. The display panel assembly may include a display panel 200, a flexible circuit board 300 electrically connected to the display panel 200, and a printed circuit board 400 electrically connected to the flexible circuit board 300.

The display panel 200 may include lower and upper glass substrates, a display unit between the lower and upper glass substrates, and a sealing member between the lower and upper glass substrates to surround the display unit. The display unit may include a liquid crystal display element, an organic light emitting diode, or the like as a pixel for displaying an image.

Although FIG. 5 shows one display panel assembly for convenience of explanation, a plurality of display panel assemblies may be seated in a laminated structure on the seating area 10*a* of the base 10. In this case, the one or more supporting members 20 and the buffering member 30 may have a length corresponding to a total thickness of the plurality of display panel assemblies, and another buffering member in the form of a plate may be between the plurality of display panel assemblies.

In the tray 100 according to the embodiment illustrated in FIG. 1, the two sides of the display panel 200 as illustrated in FIG. 5 may contact the buffering member 30. However, the portion of the buffering member 30 that is in contact with the display panel 200 may be spaced apart from the inner surface of the one or more supporting members 20 by the distance D as illustrated in FIGS. 2-3 without directly contacting the inner surface of the one or more supporting members 20.

The tray 100 may be moved or shaken while the display panel assembly is carried. The display panel 200 may be in contact with the buffering member 30 having a low hardness. Therefore, the display panel may have a reduced chance of being pushed or scratched. In addition, when impact is applied to the tray 100, the impact may be weakened by the one or more supporting members 20 having a relatively high hardness, and most of the impact applied to the one or more supporting members 20 can be attenuated by the distance (or a space) without being directly transferred to the buffering member 30. Even if the display panel 200 moves by impact due to vibration or the like, the vibration may be weakened or not transferred to the one or more supporting members 20 and may be mostly absorbed by the buffering member 30 having a relatively low hardness.

In order to obtain an impact absorbing effect as described above, the distance D is preferably set within a range of about 0.5 mm to 1.5 mm, and the distance D' is preferably set within a range of about 0.5 mm to 1.5 mm.

When the distance D is less than 0.5 mm, the impactabsorbing effect may be small and the distance D is greater than 1.5 mm, a size of the tray may be increased.

In addition, when the distance D' is less than 0.5 mm, the impact absorbing effect may be small. Preferably, the distance D' is set to about 1.5 mm so that a sufficient space for absorbing impact can be secured.

For example, when the one or more supporting members 20 and the buffering member 30 are made of a material having a high hardness and the buffering member 30 is in close contact with the one or more supporting members 20, impact applied to the one or more supporting members 20 may be directly transferred to the buffering member 30 and vibration transferred to the buffering member 30 may be directly transferred to the one or more supporting members 20. In addition, vibration of the display panel 200 may cause friction with the buffering member 30, so that the display panel 200 may be scratched or damaged.

However, embodiments of the present invention may reduce or prevent scratching of the display panel 200 by forming the buffering member 30 with a material having a hardness lower than that of the one or more supporting members 20 and disposing the buffering member 30 spaced apart from the one or more supporting members 20.

In addition, the tray 100 according to the embodiment illustrated in FIG. 1 may be commonly used corresponding to the display panel(s) 200 of various sizes and structurally easily modified depending on the number of display panel(s) 200.

For example, when the size of the display panel 200 is changed, only the buffering member 30 may be manufactured to correspond to the size of the display panel 200. In addition, when the number of display panel(s) 200 is changed, only the buffering member 30 may be manufactured to correspond to the number of display panel(s) 200. Therefore, the manufacturing cost may be reduced or minimized. In addition, the material of the buffering member 30 may be easily changed if necessary.

Figure 7:
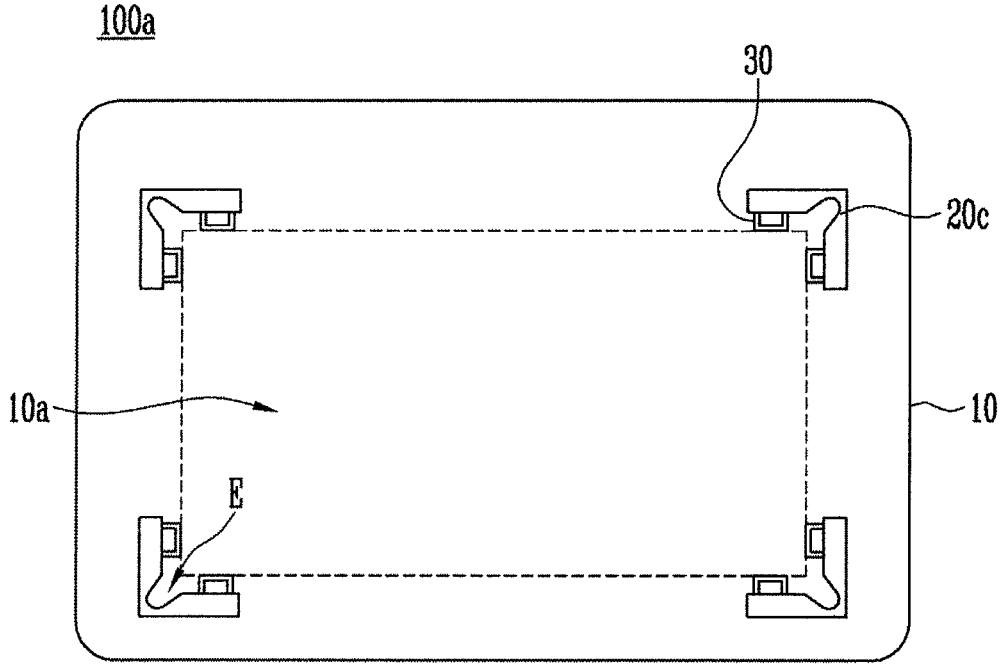
FIG. 7 is a plan view of a tray for carrying a display panel according to an embodiment of the present invention.

FIG. 7 is a plan view of a tray for carrying a display panel according to an embodiment of the present invention.

In the tray 100 for carrying a display panel according to the embodiment illustrated in FIG. 1, the corner portion of the display panel 200 may be adjacent to the one or more supporting members 20. When the display panel 200 is moved by vibration or the like, the corner portion of the display panel 200 may contact the one or more supporting members 20 and be damaged.

Referring to FIG. 7, a tray 100*a* for carrying a display panel according to the embodiment may have a recess portion E in the one or more supporting members 20 corresponding to the corner portion of the display panel 200.

Because the corner portion of the display panel 200 is spaced apart from the one or more supporting members 20 at a sufficient distance by the recess portion E, breakage of the display panel 200 due to contact with the one or more supporting members 20 can be effectively reduced or prevented.

Figure 8:
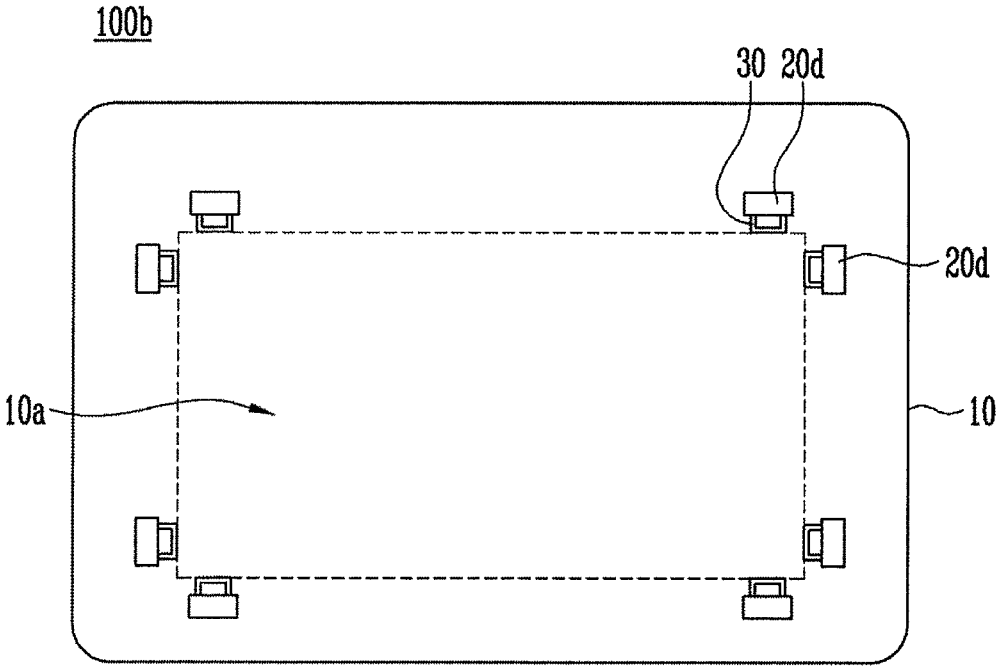
FIG. 8 is a plan view of a tray for carrying a display panel according to an embodiment of the present invention.

FIG. 8 is a plan view of a tray for carrying a display panel according to an embodiment of the present invention.

Referring to FIG. 8, a tray 100*b* for carrying a display panel according to the embodiment may include one or more supporting members 20*d* each of which corresponds to the two sides of each of the corner portions of the display panel 200.

Positions of the one or more supporting members 20*d* and the buffering members 30 may be easily and independently changed so as to correspond to one or more portions vulnerable to impact so that the corner portions of the display panel 200 may avoid damage when an impact occurs.

Figure 9:
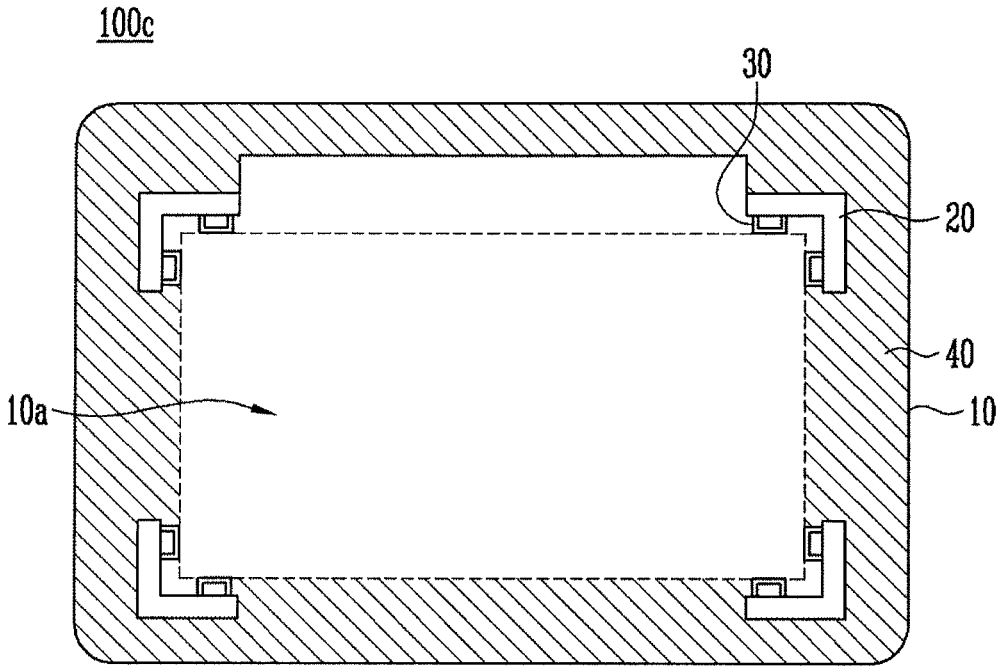
FIG. 9 is a plan view of a tray for carrying a display panel according to an embodiment of the present invention.

FIG. 9 is a plan view of a tray for carrying a display panel according to an embodiment of the present invention.

A tray 100*c* according to the embodiment may have substantially the same structure as the tray 100*a* or 100*b* as illustrated in FIGS. 7-8 except for an outer wall 40. Therefore, only differences will be explained.

Referring to FIG. 9, the tray 100*c* according to the embodiment may further include the outer wall 40 on an edge portion of the base 10 to surround the one or more supporting members 20.

The outer wall 40 may be made of the same material as the base 10. For example, the outer wall 40 may be made of a foam material, such as Styrofoam® closed-cell extruded polystyrene foam, and/or a corrugated cardboard having a multilayered structure.

When the outer wall 40 is made of the same material as the base 10, the outer wall 40 and the base 10 may be integrally formed.

Because impact applied from outside can be absorbed primarily by the outer wall 40 and the one or more supporting members 20 can be protected and supported by the outer wall 40, the tray 100*c* according to the embodiment may have a more advantageous structure in terms of stability and durability.

According to the embodiments of the invention, the tray is configured such that the buffering member is spaced a certain distance from the one or more supporting members, the amount of impact transferred to the display panel can be effectively reduced as compared with a related art tray. The display panel may be better protected from movement or impact.

In addition, because the tray according to the embodiment of the invention is configured so that only the buffering member may be replaced, the material of the buffering member may be easily changed and may be used corresponding to display panels of various suitable sizes.

As described above, the optimal or desired embodiments of the invention have been disclosed through the detailed description and the drawings. It is to be understood that the terminology used herein is for the purpose of describing the invention only and is not used to limit the scope of the invention described in the claims. Therefore, those skilled in the art will appreciate that various modifications and equivalent embodiments are possible without departing from the scope of the invention. Accordingly, the true scope of the invention should be determined by the technical idea of the appended claims, and equivalents thereof.

What is claimed is:

1. A tray for carrying a display panel, the tray comprising:

a base configured to support the display panel;

supporting members on the base, each having an inner surface corresponding to two adjacent sides of each of corner portions of the display panel; and buffering members including first portions coupled to the inner surface of each of the supporting members and configured to contact the two adjacent sides of the display panel, wherein each of the buffering members includes a second portion spaced apart from the inner surface of a corresponding one of the supporting members by a set distance, and wherein the second portion of a buffering member of the buffering members and the inner surface of the corresponding one of the supporting members are at opposing ends of a longitudinal through hole defined by the buffering member and the corresponding one of the supporting members.

2. The tray of claim 1, wherein the second portion of each of the buffering members is spaced apart from the inner surface of the corresponding one of the supporting members by a distance of about 0.5 mm to about 1.5 mm.

3. The tray of claim 1, wherein the supporting members are spaced apart from each other at the corner portions.

4. The tray of claim 1, wherein each of the supporting members comprises grooves formed on the inner surface, and wherein each of the buffering members is formed in a U shape and two legs of the U shape are configured to be inserted into the grooves.

5. The tray of claim 1, wherein each of the supporting members comprises grooves formed on the inner surface and a through hole formed in a longitudinal direction, and wherein each of the buffering members is formed in a trident shape, two legs of the trident shape are configured to be inserted into the grooves, and a middle leg of the trident shape is configured to be bent and inserted into the through hole.

6. The tray of claim 5, wherein the two legs of the trident shape are configured to be spaced apart from a bottom surface of the grooves by a set distance when inserted into the grooves.

7. The tray of claim 1, wherein the buffering members comprise a material having hardness lower than that of the supporting members.

8. The tray of claim 7, wherein the supporting members comprise at least one material selected from plastic and synthetic resin, and the buffering members comprise at least one material selected from urethane, resin and rubber.

9. The tray of claim 1, further comprising:

an outer wall on the base to surround the supporting members.

10. The tray of claim 9, wherein the outer wall is made of a foam material.

11. A tray for carrying a display panel, the tray comprising:

a base configured to support the display panel;

a supporting member on the base having an inner surface corresponding to two adjacent sides of each of corner portions of the display panel; and buffering members including first portions coupled to the inner surface of the supporting member and configured to contact the two adjacent sides of the display panel, wherein each of the buffering members includes a second portion spaced apart from the inner surface of the supporting member by a set distance, and wherein the second portion of a buffering member of the buffering members and the inner surface of the supporting member are at opposing ends of a longitudinal through hole defined by the supporting member and the buffering member.

12. The tray of claim 11, wherein each of the buffering members are spaced apart from the inner surface of the supporting member by a distance of about 0.5 mm to about 1.5 mm.

13. The tray of claim 11, wherein the supporting member comprises a recess portion corresponding to each of the corner portions of the display panel.

14. The tray of claim 11, wherein the supporting member comprises grooves formed on the inner surface, and wherein each of the buffering members is formed in a U shape and two legs of the U shape are configured to be inserted into the grooves.

15. The tray of claim 11, wherein the buffering members comprise a material having hardness lower than that of the supporting member.

16. The tray of claim 15, wherein the supporting member comprises at least one material selected from plastic and synthetic resin, and the buffering members comprise at least one material selected from urethane, resin and rubber.

17. A tray for carrying a display panel, the tray comprising:

a base configured to support the display panel;

a supporting member on the base having an inner surface corresponding to two adjacent sides of each of corner portions of the display panel; and buffering members including first portions coupled to the inner surface of the supporting member and configured to contact the two adjacent sides of the display panel, wherein each of the buffering members includes a second portion spaced apart from the inner surface of the supporting member by a set distance, wherein the supporting member comprises grooves formed on the inner surface and a through hole formed in a longitudinal direction, and wherein each of the buffering members is formed in a trident shape, two legs of the trident shape are configured to be inserted into the grooves, and a middle leg of the trident shape is configured to be bent and inserted into the through hole.

18. The tray of claim 17, wherein the two legs of the trident shape are spaced apart from a bottom surface of the grooves by a set distance when inserted into the grooves.

* * * * *